US006484639B2

(12) United States Patent
Grunder

(10) Patent No.: US 6,484,639 B2
(45) Date of Patent: Nov. 26, 2002

(54) DEVICE FOR DELIVERING A PRINTING PLATE TO A PLATE CYLINDER OF A PRINTING PRESS

(75) Inventor: Ronald Grunder, Vordemwald (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/855,706

(22) Filed: May 16, 2001

(65) Prior Publication Data

US 2002/0020319 A1 Feb. 21, 2002

(30) Foreign Application Priority Data

May 17, 2000 (EP) ..... 00810430

(51) Int. Cl.[7] ..... B41L 47/14
(52) U.S. Cl. ..... 101/477; 101/479; 101/480
(58) Field of Search ..... 101/477, 479, 101/480, 216, DIG. 49, 247, 174, 185

(56) References Cited

U.S. PATENT DOCUMENTS 4,727,807 A 3/1988 Suzuki et al.
5,454,317 A * 10/1995 Kobler et al. ..... 101/216
5,540,149 A 7/1996 Hoge

FOREIGN PATENT DOCUMENTS

| | | |
|---|---|---|
| DE | 195 08 844 | 9/1996 |
| EP | 0567754 | 11/1993 |
| EP | 0678382 | 10/1995 |
| EP | 0714771 | 6/1996 |
| EP | 09240707 | 6/1999 |

* cited by examiner

*Primary Examiner*—Leslie J. Evanisko
(74) *Attorney, Agent, or Firm*—Venable; Catherine M. Voorhees

(57) ABSTRACT

A device for delivering a printing plate having at least one edge to a plate cylinder of a printing press in a position for exchange is provided. The device includes at least one selectable exchangeable format slide-in unit insertable into the printing press. The format slide-in unit is selected to accommodate the plate cylinder. The device also includes a delivery mechanism with a number of settings corresponding to the selected format slide-in unit. The delivery mechanism determines the position of exchange that corresponds to the selected format slide-in unit.

5 Claims, 2 Drawing Sheets

DEVICE FOR DELIVERING A PRINTING PLATE TO A PLATE CYLINDER OF A PRINTING PRESS

CROSS REFERENCE TO RELATED APPLICATIONS

Priority is claimed with respect to European Patent Application No. 00810430.9-2304 filed on May 17, 2000, in the European Patent Office, the disclosure of which is herein incorporated by reference.

BACKGROUND OF THE INVENTION

The invention relates to a device for delivering a printing plate to a plate cylinder of a printing press in a position ready for exchange where one printing plate edge can be transferred to a holding fixture on the plate cylinder.

A known device of this type, disclosed in EP 0 714 771 A2, comprises a linear drive for gripping devices arranged on the printing press machine frame near the plate cylinder. These gripping devices can be advanced tangentially toward the plate cylinder. A suspension bar supported on pivoting arms extends parallel to the axis of rotation of the plate cylinder. The front edge of the printing plate to be secured is suspended from the suspension bar in a position where it can be pivoted for transferring the printing plate. The suspension bar is subsequently pivoted in the direction of the plate cylinder, thus moving it into the movement path of the gripping devices. The gripping devices guide the printing plate with its angled, front edge to an axial plate channel of the holding fixture, formed in the outer periphery of the plate cylinder. As a result, the printing plate with its angled edge can be secured tightly in the plate channel. The plate cylinder with the secured front edge of the printing plate is then rotated. The printing plate is consequently wound onto the printing cylinder until its rear edge, which is also angled, engages and is secured either in the same plate channel of the front edge or in a different one.

Another known device, disclosed in EP 0 567 754 A1, is provided with a roller and, at a distance thereto, a suction cup is arranged on a section of a printing mechanism guard on the printing press, which can be tilted upward. The printing plate to be secured is supported on the roller and held in place by the suction cup. When the hinged-on printing mechanism guard is in the tilted-up position, the section that supports the roller and the suction cup is positioned in such a way, relative to the plate cylinder, that the printing plate held by the roller and the suction cup is aligned tangential to the plate cylinder and can be supplied correctly positioned to its holding fixture.

A known method of storing the printing plate to be secured inside a magazine, disclosed in DE 195 08 844 A1, is provided with transporting means for pushing out the printing plate. Relative to the plate cylinder, this magazine is arranged on the printing press in such a way that the printing plate, which is pushed out by the transporting means, is placed with its front edge into the correct position for securing it in the holding fixture of the plate cylinder.

All of these conventional devices require that the position for exchange, in which the front edge of the printing plate to be secured is transferred to the holding fixture of the plate cylinder, is clearly determined. The conventional devices are therefore designed only for a single printing plate format and size. Plate cylinders for different printing plate formats, however, have different diameters. As a result, the holding fixtures for the plate cylinders with different diameters occupy correspondingly different positions in the printing press.

SUMMARY OF THE INVENTION

It is an object of the invention to create a device of the aforementioned type, which permits the operation with different formats.

The above and other objects are solved according to the invention by assigning a number of exchangeable format slide-in units to the printing press. These units can be inserted optionally into the printing press and accommodate the respective plate cylinder with a diameter corresponding to the selected format. The delivery mechanism is provided with a number of settings that correspond to the number of format slide-in units and determine the position of exchange that corresponds to the respectively inserted format slide-in unit.

The format slide-in units are designed to fit into a specially provided receptacle on the printing press and are driven by the latter, independent of the format dependent diameter of the plate cylinder. The plate cylinder, the rubber cylinder engaged therewith and, if necessary, a counter pressure cylinder that meshes with the rubber cylinder are respectively positioned inside the format slide-in units. The rotational axes for these cylinders and their cylinder jackets occupy different positions in the various format slide-in units because of the format dependent different radii. According to the invention, the different settings of the delivery mechanism take into account the correct changing position for the respective printing plate to be secured for each inserted format slide-in unit.

According to a particular embodiment of the device according to the invention, a positioning element determines the setting on each format slide-in unit for an opposing element. The opposing element, which can be made to engage in the positioning element, is provided on a printing plate guide element that aligns the outer edge of the printing plate to be secured. During a format change, only the printing plate guide element must be released from the engagement between its counter element and the positioning element for the format slide-in unit to be exchanged. Following the insertion of the new format slide-in unit, it must again be made to engage with its positioning element. For this, the printing plate guide element can be suspended freely moving on a suitable support device, so that its inherent weight is essentially supported during this operation and is available within grasping distance of the printing press, even in the state where it is not engaged with the positioning element.

The positioning element for the aforementioned embodiment of the format slide-in unit delivers the necessary position information for the respective setting of the delivery mechanism. In contrast, a holding fixture 28 (FIG. 2) can be provided according to an alternative embodiment, which is supported on a stationary section accommodating the format slide-in unit, in particular on the printing press. This holding fixture is connected with one free end to a printing plate guide element that aligns the edge of the printing plate to be secured and has an adjusting mechanism 30 (FIG. 2) for the number of settings for the free end that correspond to the positions for exchange. In that case, the adjusting mechanism for the holding fixture contains the information necessary to determine the appropriate positions of exchange for the various format slide-in units. This adjusting mechanism could be an articulated mechanism, for example, which snaps into various angular positions that correspond to the positions for exchange.

In that case, a manual selection of the appropriate setting on the adjusting mechanism by an operator exchanging the respective format slide-in unit does not result in a special expenditure. However, the embodiment can conceivably be modified in such a way that the printing press is provided with a sensor 32 (FIG. 2) for detecting the respectively used format slide-in unit, as well as an actuator for the automatic selection of the respective setting in response to the detection signal from the sensor.

The printing plate guide elements for the aforementioned embodiments, which may include one or several guide rollers on a support frame that can change position, function to correctly align the edges of the printing plates to be secured. In another modification of the invention, this guide element is designed such that it can be moved from the respective position of exchange to a stand-by position. The guide element is removed from the printing press in this stand-by position relative to the changing position. This permits good access during the format exchange, an unobstructed course for the printed pages during the printing operation and, at the same time, an easier loading of a new printing plate.

BRIEF DESCRIPTION OF THE DRAWINGS

Additional features, details and advantages of the invention follow from the description below, as well as the following figures.

DETAILED DESCRIPTION OF THE INVENTION

Figure 2:
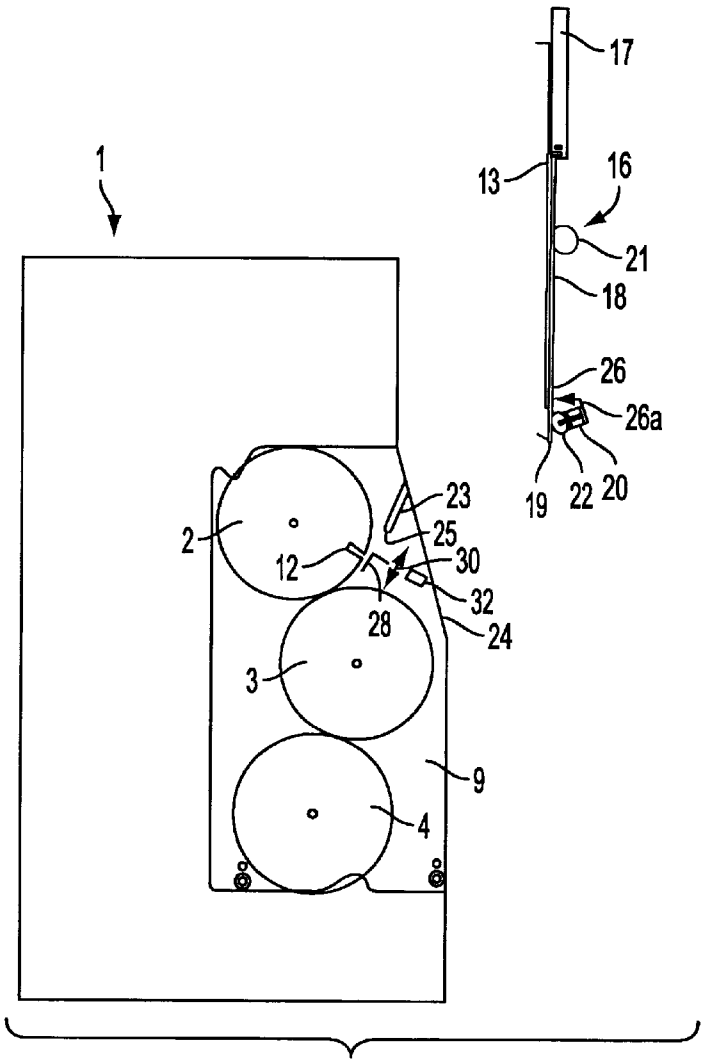
FIG. 2 shows the printing press in FIG. 1 with the delivery mechanism in a stand-by position.
Figure 1:
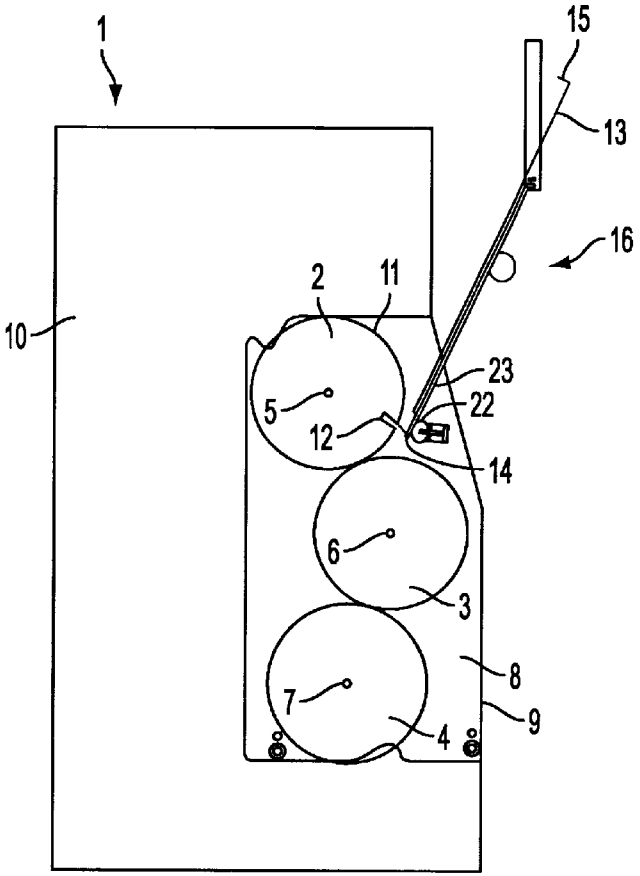
FIG. 1 shows a side view of a printing press with a slide-in unit and a mechanism for delivering a printing plate in the position for exchange in accordance with the present invention.

A printing press 1, shown in FIGS. 1 and 2, is provided in a known manner with a plate cylinder 2, a rubber cylinder 3 and a counter-pressure cylinder 4. The rotational axes 5, 6, 7 of these cylinders extend perpendicular to the drawing plane and are positioned with their ends in the axially spaced apart side parts 8 of a format slide-in unit 9, which extend parallel to the drawing plane.

Two axially spaced apart side parts 10 of the printing press 1 extend parallel to the side parts 8 of the format slide-in unit 9, into which the format slide-in unit 9 is inserted such that it can be exchanged. The rotational axes 5, 6, 7 in this case are positioned in the side parts 8 of the format slide-in unit 9 in such a way that the joint operation in the correct position with the non-replaceable remaining elements of printing press 1, particularly the elements for driving the format slide-in unit 9, is ensured once the format slide-in unit 9 is inserted.

The plate cylinder 2 is provided with a plate channel 12, which extends in axial direction and is open toward its cylinder jacket 11. In order to secure a printing plate 13 on the plate cylinder 2, the front edge 14 of the printing plate 13 is angled in such a way that it can be inserted in an approximately radial direction into the plate channel 12. The printing plate 13 can be secured with clamping means that are not shown in FIGS. 1 and 2. Following this, the plate cylinder 2 in FIG. 1 is turned in clockwise direction. As a result, the printing plate 13 is pulled through the cylinder gap, formed between the plate cylinder 2 and the rubber cylinder 3, and is fitted against the cylinder jacket 11 of plate cylinder 2. The format of printing plate 13 and the diameter of plate cylinder 2 are matched to each other in such a way that in the end, the equally angled rear edge 15 of printing plate 13 enters the plate channel 12 as well and is secured there.

Since the printing plate 13 must be exchanged relatively frequently, a mechanism 16 for delivering the printing plates 13 to the position for exchange at the plate cylinder 2 is provided to facilitate this operation. The delivery mechanism 16, shown in FIG. 2 in a stand-by position that is somewhat removed from the printing press 1, is provided for the embodiment shown with a suspension element 17, which can be displaced locally, relative to the printing press 1. The delivery mechanism 16 furthermore is provided with a hinged-on frame element 18, which is attached such that it can pivot. The free end of this frame element, which is located opposite the suspension element 17, has an angled section 19 that matches the angled front edge 14 of the printing plates 13. Near this angled section 19, a printing plate guide element 20 and at a distance thereto at least one support roller element 21 are arranged on the frame element 18. The printing plate guide element 20 supports at least one guide roller 22, which can be displaced essentially crosswise to the plane for frame element 18 and a thereon arranged printing plate 13. The printing plate guide element can also be provided with a pneumatic actuator.

The stand-by position for the delivery mechanism 16, shown in FIG. 2, is suited for fitting a printing plate 13 in such a way that it strikes with its angled front edge 14 against the angled section 19 of the frame element 18 and that it rests with its planar surface on the support roller element 21 and the guide roller 22. To keep the inserted printing plate 13 securely in the inserted position, guides, holders, or counter-rollers can be provided, which hold the printing plate 13 in the contacting position against the printing plate guide element 20. Furthermore, the support roller elements 21 as well as the guide rollers 22 are preferably arranged in pairs for supporting the two edge regions of printing plate 13.

Respectively one positioning element 23 is provided according to FIGS. 1 and 2 on both side parts 10 of the format slide-in unit 9. In the exemplary embodiment shown here, the positioning element 23 takes the form of a guide groove that is open toward the free edge 24 of the side parts 10 and is closed on the opposite end 25. The guide groove serves as positioning element for the front area 26 of frame element 18 with complementary design, which holds the printing plate guide element 20. The mechanism 16 is moved from the stand-by position, shown in FIG. 2, to the position for exchange, shown in FIG. 1, by inserting the front area 26 of the frame element 18, designed as a counter element 26*a*, into the guide groove forming the positioning element 23 with the aid of a translatory displacement of the suspension element 17 and by pivoting the frame element 18. In the process, the closed end 25 and the inclination of the positioning element 23 determine the position and orientation of the delivery mechanism 16 for the respective format slide-in unit 9 required for the position of exchange. FIG. 1 shows that, for example, through a pneumatic displacement of the guide roller 22 toward the cylinder jacket 11 of plate cylinder 2, the angled front edge 14 can be inserted in this position into the plate channel 12, which is turned toward the position for exchange. The previously described clamping operation can then be carried out.

Figure 4:
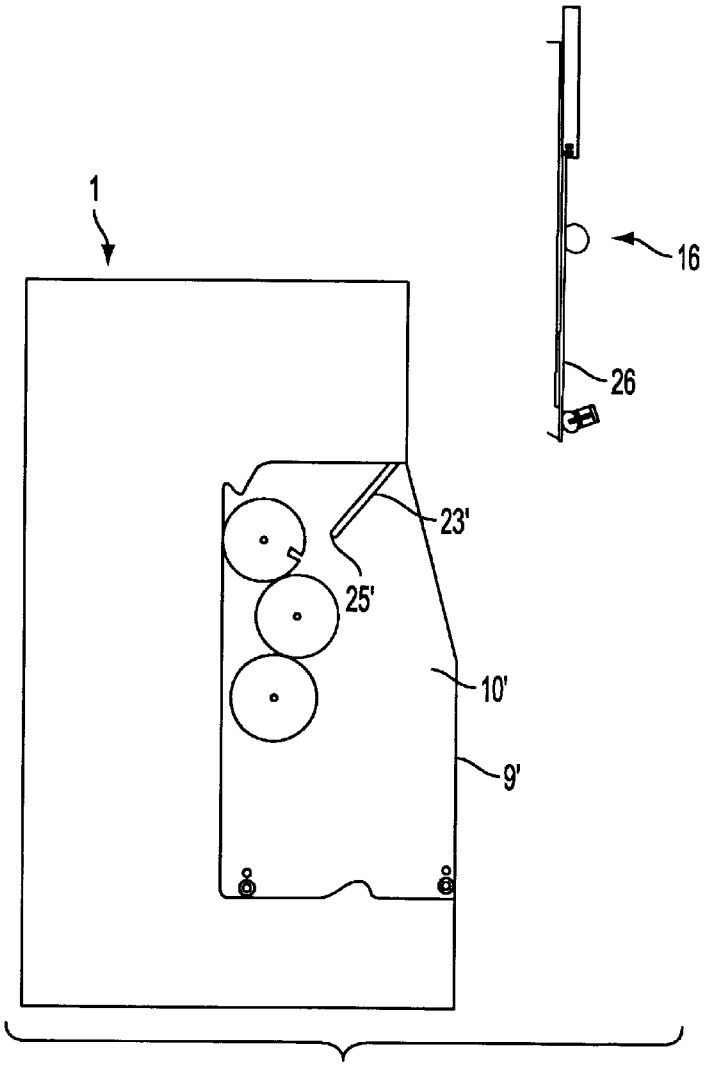
FIG. 4 shows the printing press of FIG. 3 with the delivery mechanism in a stand-by position.
Figure 3:
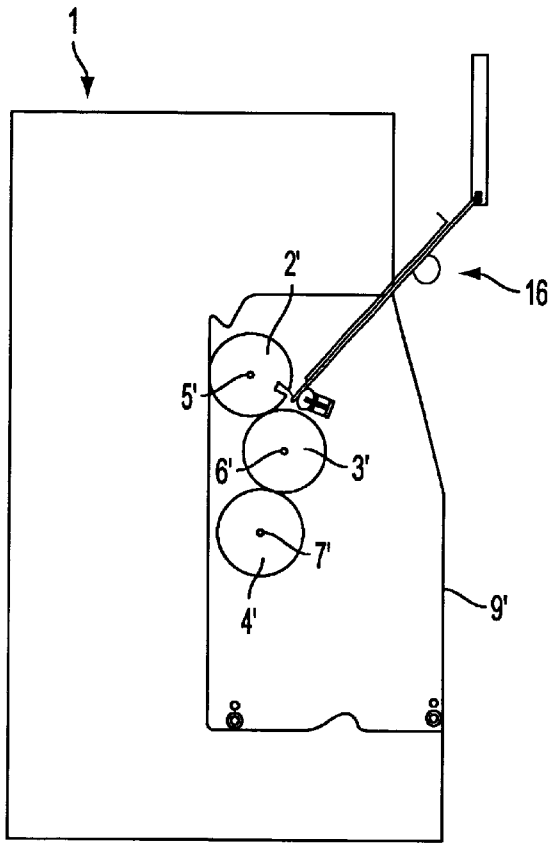
FIG. 3 shows a side view of a printing press with an alternative embodiment of the invention with a mechanism for delivery corresponding to printing plate cylinders of a smaller format.

The representations in FIGS. 3 and 4 differ from the representations in FIGS. 1 and 2 only in that a different format slide-in unit 9' for a different format is inserted into the printing press 1. All other elements are the same.

The format slide-in unit 9' differs from the format slide-in unit 9 only with respect to the position of the rotational axes 5', 6', 7' of the plate cylinder 2', the rubber cylinder 3' or the counter-pressure cylinder 4', as well as the cylinder diameter. In accordance with the smaller format used in FIGS. 3 and 4, these diameters are smaller than in FIGS. 1 and 2. This difference in the design, relative to FIG. 1, which results from the change in the position for exchange, is taken into account through the difference in the guide groove design relative to its slant and the position of closed end 25'. This guide groove functions as positioning element 23' on the side parts 10' of format slide-in unit 9'. Thus, if the delivery mechanism is inserted, as described with the aid of FIG. 1, with its frontal area 26 that functions as counter element into the guide groove 23', the delivery mechanism assumes the position of exchange that is appropriate for the exchanged format slide-in unit 9', as shown in FIG. 3.

As an alternative to the illustrated and described embodiment, an adjusting mechanism could be provided for the translatory movement of the suspension element 17 and the pivoting movement of frame element 18 instead of the positioning elements 23, 23' and the counter elements in the frontal area 26. The number of settings of this adjusting mechanism corresponds to the number of positions for exchange and the device thus assumes the correct position for exchange for each format slide-in unit 9. Instead of selecting these settings by hand, the printing press 1 could be provided with a sensor for the respective format slide-in unit 9, 9', the output signal of which is used for an automatic selection of the corresponding settings.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for delivering a printing plate having at least one edge to a plate cylinder of a printing press in a position for exchange, the device comprising:

a plurality of selectable exchangeable format slide-in units insertable into the printing press, each format slide-in unit being selected to accommodate the plate cylinder having a diameter corresponding to the selected format slide-in unit; and a delivery mechanism with a number of settings corresponding to the plurality of format slide-in units, the settings of the delivery mechanism determining the position for exchange that corresponds to the selected format slide-in unit.

2. The device according to claim 1, wherein the delivery mechanism includes a printing plate guide element for aligning the edge of the printing plate with the plate cylinder, the printing plate guide element having a counter element; and wherein each format slide-in unit includes a positioning element that determines a setting for the counter element engageable with the positioning element.

3. The device according to claim 2, wherein the printing plate guide element can be displaced from the position of exchange to a stand-by position.

4. The device according to claim 1, further comprising a holding fixture supported on a stationary part and having at least one end, the holding fixture accommodating the selected format slide-in unit, and wherein the delivery mechanism includes a printing plate guide element for aligning the edge of the printing plate with the plate cylinder and one end of the holding fixture is connected to the printing plate guide element for aligning the edge of the printing plate, the holding fixture being provided with an adjusting mechanism and having a number of settings corresponding to a plurality of positions for exchange.

5. The device according to claim 4, further comprising a sensor provided in the printing press for detecting the selected format slide-in unit and producing a detection signal; and an actuator for automatic selection of a setting corresponding to the selected format slide-in unit in response to the detection signal from the sensor.

* * * * *